US008163681B2

(12) United States Patent
Bardasz et al.

(10) Patent No.: US 8,163,681 B2
(45) Date of Patent: Apr. 24, 2012

(54) LUBRICANT FOR HYDROGEN-FUELED ENGINES

(75) Inventors: Ewa Bardasz, Mentor, OH (US); William B. Chamberlain, Kirtland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 170 days.

(21) Appl. No.: 12/517,446

(22) PCT Filed: Dec. 13, 2007

(86) PCT No.: PCT/US2007/087405

§ 371 (c)(1),
(2), (4) Date: Dec. 14, 2009

(87) PCT Pub. No.: WO2008/079715

PCT Pub. Date: Jul. 3, 2008

(65) Prior Publication Data

US 2010/0101518 A1 Apr. 29, 2010

Related U.S. Application Data

(60) Provisional application No. 60/871,162, filed on Dec. 21, 2006.

(51) Int. Cl.

| | |
|---|---|
| ***C10M 169/04*** | (2006.01) |
| ***C10M 141/10*** | (2006.01) |
| ***C10L 1/22*** | (2006.01) |

(52) U.S. Cl. ..... 508/110; 508/192; 508/372

(58) Field of Classification Search ..... 508/110, 508/192, 372
See application file for complete search history.

(56) References Cited

U.S. PATENT DOCUMENTS

| | | | | |
|---|---|---|---|---|
| 4,263,153 | A * | 4/1981 | O'Halloran et al. | 508/227 |
| 2004/0213735 | A1* | 10/2004 | Hodges | 423/651 |
| 2005/0043191 | A1 | 2/2005 | Farng et al. | |
| 2005/0143266 | A1* | 6/2005 | Yagishita | 508/294 |

FOREIGN PATENT DOCUMENTS

| | | |
|---|---|---|
| EP | 0280580 | 8/1988 |
| EP | 0725129 | 8/1996 |
| EP | 1544279 | 6/2005 |

OTHER PUBLICATIONS

Corresponding PCT Publication and Search Report No. Wo 2008/079715 A1 published Jul. 3, 2008.
Written Opinion of corresponding International Application No. PCT/US2007/087405 dated Apr. 22, 2008.

* cited by examiner

*Primary Examiner* — Walter D Griffin
*Assistant Examiner* — Francis C Campanell
(74) *Attorney, Agent, or Firm* — David M. Shold; Christopher D. Hilker

(57) ABSTRACT

A lubricant composition of a synthetic oil of lubricating viscosity, 3 to 6 percent by weight of a nitrogen-containing dispersant, 1 to 2.5 weight percent of an overbased magnesium detergent, 1 to 5 weight percent of an antioxidant; and 0.25 to 1.5 weight percent of a friction modifier is useful for lubricating a hydrogen-fueled engine. The composition will typically contain less than 0.01 weight percent Ca, less than 0.01 weight percent Zn, less than 0.06 weight percent P, and will have a sulfated ash level of less than 1.2%.

18 Claims, No Drawings

LUBRICANT FOR HYDROGEN-FUELED ENGINES

BACKGROUND OF THE INVENTION

The present invention relates to lubricants for engines, especially hydrogen-fueled internal combustion engines.

In the quest to improve air quality and comply with strict emission limits, many engine and vehicle manufacturers are exploring the use of hydrogen, in particular "neat" or pure hydrogen as a fuel for internal combustion engines. Many experts suggest hydrogen as an alternative fuel capable of furthering energy self-sufficiency and as an aid in securing renewable, affordable energy sources.

One of the environmental advantages of using hydrogen as a fuel is also a potential drawback. The product of combustion of hydrogen (apart from contaminants) is water, and in particular hot vaporous water. In part related to this phenomenon, burning hydrogen in an engine can create several performance-related challenges, including engine backfire on hot summer days, engine detonation (that is, misfiring or knocking) due to preignition, reduced sparkplug life due to deposit formation from the lubricant or contaminants, and corrosive or rust attack on piston rings, cylinder heads, and the combustion chamber generally, due to unusually high water content in the used oils. Also, combustion of hydrogen, as a gaseous fuel, may lead to higher levels of engine deposits.

Following extensive testing, the applicants have discovered a lubricant formulation which can be used to lubricate hydrogen-fueled engines while minimizing one or more of the above-mentioned problems and generally maintaining good engine durability, e.g., low wear.

SUMMARY OF THE INVENTION

The present invention provides a lubricant composition comprising (a) at least one synthetic oil of lubricating viscosity; (b) 3 to 6 percent by weight of at least one nitrogen-containing dispersant; (c) 1 to 2.5 weight percent of at least one overbased magnesium detergent; (d) 1 to 7 weight percent of at least one antioxidant; and (e) 0.1 to 2.5 weight percent of at least one friction modifier; said composition containing less than 0.01 weight percent Ca, less than 0.01 weight percent Zn, 0.01 to 0.10 weight percent P, and having a sulfated ash level (ASTM D874) of less than 1.2%.

The invention further provides a method for lubricating an engine, comprising supplying thereto the above lubricant composition.

DETAILED DESCRIPTION OF THE INVENTION

Various preferred features and embodiments will be described below by way of non-limiting illustration.

One element of the present lubricant is an oil of lubricating viscosity, sometimes also referred to as a base oil. The base oil used in the inventive lubricating oil composition may contain any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≦0.03 | and | ≧90 | 80 to 120 |

-continued

| Base Oil Category | Sulfur (%) | | Saturates (%) | Viscosity Index |
|---|---|---|---|---|
| Group III | ≦0.03 | and | ≧90 | >120 |
| Group IV | All polyalphaolefins (PAOs) | | | |
| Group V | All others not included in Groups I, II, III or IV | | | |

However, the base oil of the lubricants of the present invention will include a synthetic oil of lubricating viscosity. Groups I, II and III are mineral oil base stocks. Group III mineral oils are highly refined oils and are thus considered synthetic base oils for the purpose of this invention. The oil of lubricating viscosity, then, can include natural or synthetic lubricating oils and mixtures thereof. Mixture of mineral oil and synthetic oils, particularly polyalphaolefin oils and polyester oils, are often used.

The oil of lubricating viscosity of the present invention will comprise at least one synthetic oil. Synthetic lubricating oils include certain highly refined or "severely hydroprocessed" hydrocarbon oils, which will have a viscosity index of greater than 120, as well as halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises the esters of dicarboxylic acids and those made from C5 to C12 monocarboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Hydrotreated naphthenic oils are also known and can be used, as well as oils prepared by a Fischer-Tropsch gas-to-liquid synthetic procedure, including from hydroisomerized waxes or Fischer-Tropsch waxes.

In certain embodiments, the synthetic oil may be or comprise a polyalpha olefin. (PAO). Typically, the polyalphaolefins are derived from monomers having from 4 to 30, or 4 to 20, or 6 to 16 carbon atoms. Examples of useful PAOs include those derived from decene. These PAOs may have a kinematic viscosity of 3 to 150, or 4 to 100, or 4 to 8 $mm^2/s$ (cSt) at 100° C. Examples of PAOs include 4 cSt polyolefins, 6 cSt polyolefins, 40 cSt polyolefins and 100 cSt polyalphaolefins, which have nominal 100° C. kinematic viscosities of 4, 6, 40, and 100 $mm^2/s$, respectively.

In a similar way, synthetic oils may be prepared by polymerization of internal olefins, that is, olefins in which the unsaturation is not in the alpha position. Such materials are sometimes referred to as poly-internal-olefins.

In certain embodiments the synthetic oil may comprise the majority of the oil component of the lubricant composition. The synthetic oil may, comprise, for instance, at least 60 percent, 80 percent, 90 percent, or 95 percent by weight of the oil component. The balance of the oil component may be a natural oil, such as a mineral oil, described below. In certain embodiments the amount of mineral oil is less than 10 percent by weight or less than 8 or 6 or 4 percent (e.g., about 5 percent by weight) of the entire lubricating composition. Such a small amount of a mineral oil may be added as a separate component. Or, as frequently is the case, lubricant additives may be supplied in solution in mineral oil as a diluent oil, and this diluent oil may be the source of relatively small amounts of mineral or other natural oil in the composition.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity, as well as oils derived from coal or shale.

Natural oils may include unrefined, refined, and rerefined oils. Unrefined oils are those obtained directly from a natural (or synthetic, as the case may be) source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products. However, re-refined oils will still be considered "natural" rather than "synthetic" oils for the purpose of this invention if their viscosity index does not exceed 120.

The term "base oil" is sometimes used to include not only the oil itself but also viscosity modifiers or pour point depressants, which are typically polymeric materials added to affect the high and low temperature properties of the oil. As used herein, the term "oil of lubricating viscosity" is not intended to include viscosity modifier or pour point depressant, which materials will be accounted for separately.

Another component of the present invention is a nitrogen-containing dispersant. Such dispersants are well known in the field of lubricants and include primarily what are sometimes referred to as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. These materials are characterized by a polar group attached to a relatively high molecular weight hydrocarbon chain. Typical ashless dispersants include N-substituted long chain alkenyl succinimides (succinimide dispersants), having a variety of chemical structures including typically

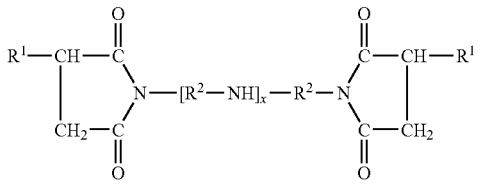

where each $R^1$ is independently an alkyl or alkenyl group, optionally substituted with additional succinimide groups, frequently a polyisobutylene group with a molecular weight of 500-5000, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Other types of linkages to the $R^1$ are also possible. Succinimide dispersants are more fully described in U.S. Pat. Nos. 4,234,435 and 3,172,892. Suitable succinimide dispersants include those prepared from a substituted succinic anhydride (made by either a chlorine-assisted process or a thermal process as described in U.S. Application 2005-0202981, Eveland et al., Sep. 15, 2005), having a polyisobutene substituent of molecular weight about 1000, e.g., 800-1600, an amine component corresponding to tetraethylenepentamine, and an overall TBN of 80 or 100 to 150 (oil free). Such a material may be prepared by reacting 86.7 parts by weight of the polyisobutene-substituted succinic anhydride (prepared by a thermal process), with 13.3 parts of TEPA in the presence of oil.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Such materials may be nitrogen-containing dispersants if one of the components, e.g., the alcohol component, also contains a nitrogen atom. One such alcohol component is trihydroxymethylaminomethane ("THAM"). Alternatively, the acylating agent may be reacted with a mixture of alcohol and amine.

Another class of nitrogen-containing ashless dispersant is Mannich bases. These are materials which are formed by the condensation of a higher molecular weight, alkyl substituted phenol, an alkylene polyamine, and an aldehyde such as formaldehyde. Such materials may have the general structure

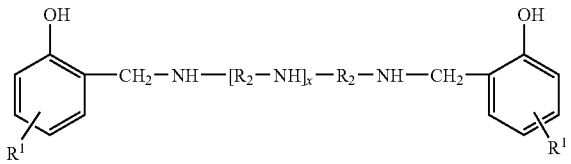

(including a variety of isomers and the like) and are described in more detail in U.S. Pat. No. 3,634,515.

Other nitrogen-containing dispersants include polymeric dispersant additives, which are generally hydrocarbon-based polymers which contain nitrogen-containing polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of the dispersant in a fully formulated lubricant will typically be 3 to 6 percent by weight, alternatively 3.5 to 5.5 percent by weight, or 4 to 5 percent. In a concentrate the amount will typically be significantly higher, e.g., 5 to 40 percent or 10 to 30 percent by weight.

The lubricant formulation will also typically contain one or more overbased magnesium-containing detergents, in an amount which does not provide an excessive amount of sulfated ash to the composition. Metal-containing detergents are typically overbased materials, or overbased detergents. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base (in the present case, a Mg base), and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

While the metal compounds useful in making the basic metal salts are generally any Group 1 or Group 2 metal compounds (CAS version of the Periodic Table of the Elements), for the present invention magnesium is desired. The Group 1 metals of the metal compound include Group 1a alkali metals such as sodium, potassium, and lithium, as well as Group 1b metals such as copper. The Group 1 metals are preferably sodium, potassium, lithium and copper. The Group 2 metals of the metal base include the Group 2a alkaline earth metals such as magnesium, calcium, and barium, as well as the Group 2b metals such as zinc or cadmium. Generally the metal compounds are delivered as metal salts. The anionic portion of the salt can be hydroxide, oxide, carbonate, borate, or nitrate.

Such overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In one embodiment the lubricants of the present invention can contain an overbased sulfonate detergent of high total base number (TBN, expressed as mg KOH/g of overbased material, see for instance ASTM D 4739). A high TBN material is a material which has a high metal ratio. A high TBN sulfonate detergent can have a TBN of at least 300, e.g., 300 to 400, on an oil-containing basis, i.e. including the amount of diluent oil customarily present with such salts (typically 40 to 50, e.g., 42 to 47 percent oil). If a high TBN overbased sulfonate detergent is used, its amount in the composition can be 0.2 to 3% or 0.25 to 2.5% or 0.3 to 2.0%, expressed here on an oil-free basis. In certain embodiments, the TBN of the magnesium detergent used herein may be at least 200, or 300 to 1000 expressed on an oil-free basis (or at least about 90 or about 135 to about 450 as expressed in the presence of customary diluent oil).

Another overbased material which can be present is an overbased phenate detergent. Such materials are often available as sulfur-bridged species, and it may also be desirable that such materials are substantially or entirely absent, in order to reduce the amount of sulfur contributed therefrom.

In one embodiment, the overbased material is an overbased detergent selected from the group consisting of overbased salixarate detergents, overbased saligenin detergents, overbased salicylate detergents, and overbased glyoxylate detergents, and mixtures thereof. Overbased saligenin detergents are commonly overbased magnesium salts which are based on saligenin derivatives. A general example of such a saligenin derivative can be represented by the formula

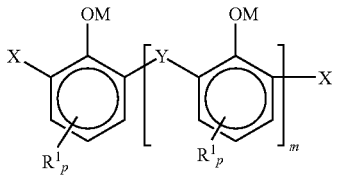

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion, $R^1$ is a hydrocarbyl group containing 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen.

As used herein, the expression "represented by the formula" indicates that the formula presented is generally representative of the structure of the chemical in question. However, it is well known that minor variations can occur, including in particular positional isomerization, that is, location of the X, Y, and R groups at different position on the aromatic ring from those shown in the structure. The expression "represented by the formula" is expressly intended to encompass such variations.

Saligenin detergents are disclosed in greater detail in U.S. Pat. No. 6,310,009, with special reference to their methods of synthesis (Column 8 and Example 1) and preferred amounts of the various species of X and Y (Column 6). Salixarate detergents are overbased materials that can be represented by a substantially linear compound comprising at least one unit of formula (I) or formula (II):

(I)

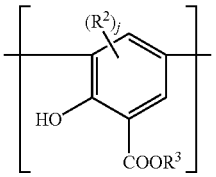

(II)

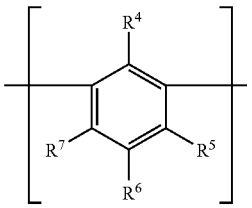

each end of the compound having a terminal group of formula (III) or formula (IV):

(III)

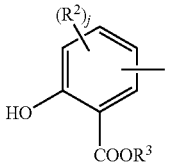

(IV)

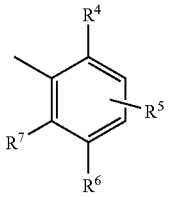

such groups being linked by divalent bridging groups A, which may be the same or different for each linkage; wherein in formulas (I)-(IV) $R^3$ is hydrogen or a hydrocarbyl group; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is about 0.1:1 to about 2:1.

The divalent bridging group "A," which may be the same or different in each occurrence, includes —CH2- (methylene bridge) and —CH2OCH2- (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which may have, for instance, the general structure

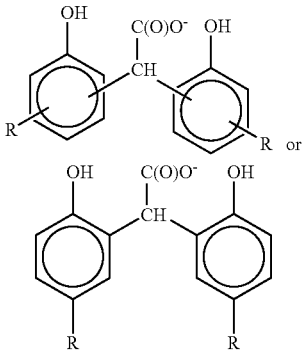

wherein each R is independently an alkyl group containing at least 4 or at least 8 carbon atoms, provided that the total number of carbon atoms in all such R groups is at least 12, or at least 16 or 24. Alternatively, each R can be an olefin polymer substituent. It will be understood that other cyclic or aromatic structures than those illustrated above may be employed. The acidic material upon from which the over-based glyoxylate detergent is prepared is the condensation product of a hydroxyaromatic material such as a hydrocarbyl-substituted phenol with a carboxylic reactant. Examples of the carboxylic reactant include glyoxylic acid and other omega-oxoalkanoic acids, keto alkanoic acids such as pyruvic acid, levulinic acid, ketovaleric acids, ketobutyric acids and numerous others. Overbased glyoxylic detergents and their methods of preparation are disclosed in greater detail in U.S. Pat. No. 6,310,011 and references cited therein.

The overbased detergent can also be an overbased salicylate. The salicylic acids preferably are hydrocarbyl-substituted salicylic acids, preferably aliphatic hydrocarbon-substituted salicylic acids wherein each substituent contains an average of at least 8 carbon atoms per substituent and 1 to 3 substituents per molecule. The substituents can be polyalkene substituents, where polyalkenes include homopolymers and interpolymers of polymerizable olefin monomers of 2 to about 16, such as 2 to 6, or 2 to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the hydrocarbyl substituent group or groups on the salicylic acid contains 7 to 300 carbon atoms and can be an alkyl group having a molecular weight of 150 to 2000. The polyalkenes and polyalkyl groups are prepared by conventional procedures, and substitution of such groups onto salicylic acid can be effected by known methods. Overbased salicylate detergents and their methods of preparation are disclosed in U.S. Pat. Nos. 4,719,023 and 3,372,116.

Other overbased detergents include overbased detergents having a Mannich base structure as, disclosed in U.S. Pat. No. 6,569,818.

The amount of the overbased magnesium detergent can typically be 1 to 2.5 percent by weight, or 1.2 to 2.2 percent or 1.4 to 2.0, calculated on an active chemical basis (that is, excluding diluent oil). In certain embodiments, the overbased magnesium detergent may be present in an amount to contribute 5 to 12 TBN to the composition.

A significant feature of the detergent is that it is predominantly not a calcium-containing detergent. While small amounts of calcium may be permitted in the lubricants of the present invention, there will typically be less than 0.01 weight percent calcium in the entire lubricant, e.g., 0 to 0.01 percent. Alternative amounts may be 0.0001 to 0.008 percent, or 0.0005 to 0.005 percent or 0.001 to 0.003 percent or less than 0.002 percent, that is, substantially free from calcium. In certain embodiments, no calcium-containing detergents and indeed not calcium from any source are intentionally added to or present in the lubricant.

The present invention will also include one or more antioxidants. Antioxidants for use in lubricant compositions are well known and include a variety of chemical types including phenate sulfides, phosphosulfurized terpenes, sulfurized esters, aromatic amines, and hindered phenols.

Aromatic amines are typically of the formula

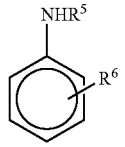

wherein $R^5$ is a phenyl group or a phenyl group substituted by $R^7$, and $R^6$ and $R^7$ are independently a hydrogen or an alkyl group containing 1 to 24 carbon atoms. In one embodiment, $R^5$ is a phenyl group substituted by $R^7$, and $R^6$ and $R^7$ are alkyl groups containing from 4 to 20 carbon atoms. In one embodiment the antioxidant can be an alkylated diphenylamine such as nonylated diphenylamine containing typically some of the formula

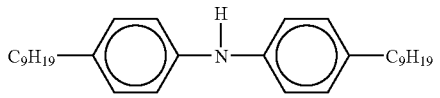

Hindered phenol antioxidants are typically alkyl phenols of the formula

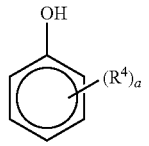

wherein $R^4$ is an alkyl group containing 1 to 24 carbon atoms and a is an integer of 1 to 5. In certain embodiments $R^4$ contains 4 to 18 carbon atoms or 4 to 12 carbon atoms. $R^4$ may be either straight chained or branched chained, especially branched. Suitable values a include 1 to 4, such as 1 to 3 or, particularly, 2. In certain well-known embodiments, the phenol is a butyl substituted phenol containing 2 or 3 t-butyl groups. When a is 2, the t-butyl groups may occupy the 2,6-positions, that is, the phenol is sterically hindered:

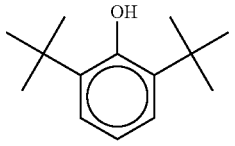

The antioxidant can be, and typically is, further substituted at the 4-position with any of a number of substituents, such as hydrocarbyl groups or groups bridging to another hindered phenolic ring.

Also included among the antioxidants are hindered, ester-substituted phenols such as those represented by the formula

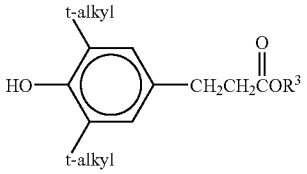

wherein t-alkyl can be, among others, t-butyl, $R^3$ is a straight chain or branched chain alkyl group containing 2 to 22 carbon atoms, such as 2 to 8, 2 to 6, or 4 to 8 carbon atoms or 4 or 8 carbon atoms. $R^3$ may be a 2-ethylhexyl group or an n-butyl group. Hindered, ester-substituted phenols can be prepared by heating a 2,6-dialkylphenol with an acrylate ester under base catalysis conditions, such as aqueous KOH.

Antioxidants also include sulfurized olefins such as mono-, or disulfides or mixtures thereof. These materials generally have sulfide linkages having 1 to 10 sulfur atoms, for instance, 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants as well as serving in various other functions, such as friction modifiers (discussed below) and antiwear agents. The use of molybdenum and sulfur containing compositions in lubricating oil compositions as antiwear agents and antioxidants is known. U.S. Pat. No. 4,285,822, for instance, discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition. If a molybdenum compound (or other material with multiple functional activity including friction modifier activity) is present, it may be considered to constitute the friction modifier as described below. However, if another friction modifier is also present in an amount sufficient to satisfy the friction modifier weight requirements of the present invention, the molybdenum compound may then be considered to constitute or contribute to the required amount of antioxidant.

In certain embodiment a mixture of antioxidants are employed such as both a phenolic and an aromatic amine antioxidant, or alternatively phenolic, aromatic amine, and phosphosulfurized olefin antioxidants. The amount of each in a final lubricant formulation may be 0.1 to 7% or 1 to 5% (by weight), or 0.15 to 4.5%, or 0.2 to 4%, or 0.2 to 2% or 0.2 to 1%. The total amount of antioxidant may also be 1 to 7% or 1 to 5%, or 1.5 to 4.5% or 2 to 4% by weight. In a concentrate, the amounts will be correspondingly increased by about a factor of about 10.

Another component of the present invention is a friction modifier. Friction modifiers comprise a diverse group of chemicals, some of which are metal containing, some of which are ashless. Many friction modifiers contain a relatively long chain fatty hydrocarbyl group. Friction modifiers thus include fatty esters, including include sorbitan and sorbitol partial carboxylic esters, such as sorbitan mono- di- and trioleates, as well as the corresponding stearate and laurate esters, or mixtures thereof; sorbitol mono-, di-, and trioleates, as well as the corresponding stearate and laurate esters, or mixtures thereof; glycerol fatty esters, such as glycerol monooleate, glycerol dioleate, the corresponding mono- and di-esters from $C_{10}$ to $C_{22}$ acids such as stearic, isostearic, behenic, and lauric acids; corresponding mono- and diesters made from fatty acids and 2-methyl-2-hydroxymethyl-1,3-propanediol, 2-ethyl-2-hydroxymethyl-1,3-propanediol, and tris-hydroxymethyl-methane; the mono-, di-, and triesters from $C_{10}$ to $C_{22}$ fatty carboxylic acids and monopentaerythritol; the corresponding partial fatty acid esters of di-pentaerythritol.

Friction modifiers also include the fatty acid amides such as oleylamide, stearylamide, and linoleylamide.

Among the fatty acids that may be used are those acids which may be obtained by the hydrolysis of a naturally occurring vegetable or animal fat or oil. These acids usually contain 8 or 10 to 22 or 16 to 18 carbon atoms and include, for example, palmitic acid, stearic acid, oleic acid, and linoleic acid.

Various amines, particularly tertiary amines are effective friction modifiers. Examples of tertiary amine friction modifiers include N-fatty alkyl-N, N-diethanolamines, N-fatty alkyl-N,N-di[ethoxyethanol]amines. Such tertiary amines can be prepared by reacting a fatty alkyl amine with an appropriate number of moles of ethylene oxide. Tertiary amines derived from naturally occurring substances such as coconut oil and oleylamine are commercially available under the trade designation Ethomeen™. Particular examples are the Ethomeen-C™ and the Ethomeen-O™ series.

Sulfur-containing compounds such as sulfurized $C_{12-24}$ fats, alkyl sulfides and polysulfides wherein the alkyl groups contain from 1 to 8 carbon atoms, and sulfurized polyolefins also may function as friction modifiers in the lubricating oil compositions of the invention.

Other friction modifiers include borate esters, such as borated fatty epoxides. Borated epoxides are in fact borate esters, as the epoxy ring opens during reaction to form the ester.

The amount of the friction modifier in the composition will typically be 0.1 or 0.2 or 0.25 to 2.5 or 0.25 to 1.5 percent by weight, or 0.5 to 1.0 percent, or 0.6 to 0.9 percent. For example, oleamide may be used at 0.1 to 0.2 percent; nitrogen-free friction modifiers may be used at 0.25 to 2.5 percent.

The lubricants composition of the present invention will be formulated in such a way as to be low in calcium, zinc, phosphorus, and sulfated ash (ASTM D874). The low amounts of Ca have been described above. The amount of zinc will be less than 0.01 weight percent in the composition, or less than 0.005 or less than 0.001 weight percent. The sulfated ash will be less than 1.2% or less than 1.1 or 1.05%.

The amount of phosphorus will be up to 0.1 weight percent, although it is desirable that at least a small amount of phosphorus be present. Thus, suitable amounts of phosphorus in the lubricant formulation include 0.01 to 0.10 weight percent, or 0.015 to 0.06 weight percent, or 0.02 to 0.05 weight percent. Many phosphorus components are known as antiwear agents, extreme-pressure agents, or friction modifiers. The phosphorus may be added, for instance, in the form of a phosphate ester. Phosphate esters include mono-, di-, or tri-esters prepared from alcohols of 1 to 30 carbon atoms, for instance, 4 to 5, or 8, or 10, or 12 to 14, or 14 to 18 carbon atoms, or mixtures thereof. Also included are the sulfur-containing analogues, that is, thiophosphate esters. Amine salts, including salts with alkylamines of various chain lengths, may be used for both the phosphate esters and thiophosphate esters. Suitable examples also include triarylphosphates such as triphenylphosphate. Phosphite and thiophosphite esters may also be suitable, including dialkyl hydrogen phosphites such as dibutyl hydrogen phosphite. The phosphorus may also be present as a phosphonate, such as a polyolefin thiophosphoic acid ester. In certain embodiments, the phosphorus may be added in the form of a phosphosulfurized olefin (e.g., the reaction product of $P_2S_5$ with pinene), which may also serve as an antioxidant component.

Other materials will normally be present in the lubricant in order to provide a better balance of performance properties, while retaining low concentrations of calcium, zinc, phosphorus, and sulfated ash.

A material which may be optionally present or which may be absent is a metal (e.g., zinc) salt of a phosphorus acid, including a thiophosphorus acid, although the amounts of such materials will normally be restricted in order to achieve the low levels of zinc and phosphorus of the present invention. Such materials include metal salts of the formula

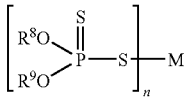

wherein $R^8$ and $R^9$ are independently hydrocarbyl groups containing 3 to 30 or to 20, to 16, or to 14 carbon atoms. These materials are readily obtainable by the reaction of phosphorus pentasulfide ($P_2S_5$) and an alcohol or phenol to form an O,O-dihydrocarbyl phosphorodithioic acid corresponding to the formula

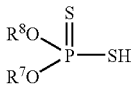

The metal M, having a valence n, generally is tin, manganese, cobalt, nickel, zinc, or copper. If the basic metal compound is zinc oxide, the resulting metal compound is represented by the formula

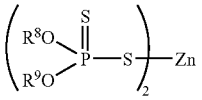

The $R^8$ and $R^9$ groups are independently hydrocarbyl groups that may be free from acetylenic and usually also from ethylenic unsaturation. They are typically alkyl, cycloalkyl, aralkyl or alkaryl group and have 3 to 20 carbon atoms, preferably 3 to 16 carbon atoms and most preferably up to 13 carbon atoms, e.g., 3 to 12 carbon atoms. The alcohol which reacts to provide the $R^8$ and $R^9$ groups can be a mixture of a secondary alcohol and a primary alcohol, for instance, a mixture of 2-ethylhexanol and isopropanol or, alternatively, a mixture of secondary alcohols such as isopropanol and 4-methyl-2-pentanol. In one embodiment, at least 50% of the alkyl groups (derived from the alcohol) in the dialkyldithiophosphate are secondary groups, that is, from secondary alcohols. Such materials are the commercially well-known zinc dialkyldithiophosphates or simply zinc dithiophosphates (ZDPs). In certain embodiments, there is no zinc or ZDP which is intentionally added to the composition.

Viscosity index improvers (viscosity modifiers) of various types can be present, although in certain embodiments they may also be excluded. As an example, olefin copolymer viscosity index improvers may be excluded from the lubricant formulations if desired, since in some circumstances such materials are believed to have led to increased deposit formation. For instance, in certain embodiments the amount of polymeric viscosity index improver is less than 1%, e.g., 0.001 to 1%, or less than 0.1% or even 0.01%, thus being substantially absent. If the viscosity index improver is not substantially absent, it may be present in amounts of 1 to 15 percent by weight, or 2 to 10 or 3 to 6 percent. Viscosity index improvers are generally polymeric species which include polyisobutenes, polymethacrylates, polyacrylates, hydrogenated diene polymers, polyalkyl styrenes, hydrogenated alkenyl aryl conjugated diene copolymers, and polyolefins. Among these also are dispersant viscosity modifiers, that is, viscosity index improvers that contain polar functionality, often nitrogen-containing functionality, which imparts dispersant performance characteristics to the polymer. Known dispersant viscosity modifiers (DVMs) include those made from ethylene-propylene copolymers that have been radically grafted with maleic anhydride and reacted with various amines, including aromatic amines. DVMs of this type are disclosed in, for instance, U.S. Pat. Nos. 6,107,257 and 6,107,258. Other polymer backbones have also been used for preparing DVMs or other materials with dispersant properties. For example, polymers derived from isobutylene and isoprene have been used in preparing dispersants and are reported in WO 01/98387. Also, nitrogen-containing esterified carboxyl-containing interpolymers prepared from maleic anhydride and styrene-containing polymers are known from U.S. Pat. No. 6,544,935. Other DVMs include an isobutylene-diene (e.g., isoprene) copolymer having an $\overline{M}_n$ of about 1000 to about 25,000, containing thereon an average of about 0.1 to 2 units, per each 1000 units of $\overline{M}_n$ of the polymer, of groups containing carboxylic acid functionality or reactive equivalent thereof, said groups derived from at least one α,β-unsaturated carboxylic compound (e.g., maleic anhydride), reacted with an amine component comprising at least one aromatic amine containing at least one N—H group, as described in PCT patent application WO2005/087821. Another DVM is an interpolymer of monomer-derived units of (i) at least one of an aliphatic olefin containing from 2 to 30 carbon atoms and a vinyl aromatic monomer (preferably, e.g., styrene), and (ii) at least one alpha, beta-unsaturated acylating agent (e.g., maleic anhydride); wherein a portion of said acylating agent monomers is esterified with a mixture of C4 and C8-C16 alcohols, and wherein a portion of said acylating agent monomers is condensed with at least one aromatic amine containing at least one N—H group, as described in PCT patent application WO2005/103093. Suitable aromatic amines include 4-phenylazoaniline, 4-aminodiphenylamine, 2-aminobenzimidazole, and N,N-dimethylphenyleneidamine.

Pour point depressants are another additive sometimes included in the lubricating oils described herein. See for example, page 8 of "Lubricant Additives" by C. V. Smalheer and R. Kennedy Smith (Lesius-Hiles Company Publishers, Cleveland, Ohio, 1967).

Yet other conventional components may also be present in the lubricants of the present invention. Such materials include corrosion inhibitors and rust inhibitors such as various acid-containing compounds. Other optional components are extreme pressure and anti-wear agents other than those described above, which include chlorinated aliphatic hydrocarbons, and zinc dithiocarbamates (although the amount of zinc contributed thereby should be restricted as earlier described).

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

These and other additives are described in greater detail in U.S. Pat. No. 4,582,618 (column 14, line 52 through column 17, line 16, inclusive).

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Hydrogen-fueled vehicles include vehicles with internal combustion engines. Such engines may be spark-ignited, even though they may be designed along the lines characteristic of diesel-fueled engines. The source of hydrogen may be relatively pure hydrogen gas, store onboard in a high-pressure tank or other storage device. Alternatively, the hydrogen may be supplied by on-board hydrogen-producing fuel cells. Such systems may use hydrogen-rich fuels such as methanol, natural gas, or gasoline, which is converted into hydrogen gas by an onboard reformer. In a reformer, the fuel is vaporized and processed in a reactor to produce hydrogen and carbon monoxide gas via a water/gas shift reaction. The CO is subsequently catalytically reacted with water to form carbon dioxide and additional hydrogen.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLE

A lubricant formulation is prepared comprising the following components:

57.6% synthetic poly-α-olefin, 8 $mm^2/s$ (cSt) (100° C.)
24.7% synthetic poly-α-olefin, 40 $mm^2/s$ (100° C.)
1.99% commercial polyol ester, 6.9 $mm^2/s$ (100° C.)(EMERY 2969B™)
8.0% succinimide dispersant, including 45% oil
1.8% overbased Mg alkylbenzenesulfonate detergent, 400 TBN, including 42% oil
1.0% overbased Mg alkylbenzenesulfonate detergent, 100 TBN, including 46% oil
4.2% antioxidant mixture (ester-substituted hindered phenol, alkylaromatic amine, and phosphosulfurized olefin)
0.75% friction modifiers (linear fatty monoester and oleamide)
0.01% commercial antifoam agent This fluid is all magnesium based, low SA (1.0%) low P (0.03%) and zinc free, in a synthetic base stock.

This lubricant formulation is tested for use in a fleet of hydrogen-fueled busses. The test lasts for about 12,000 km.

The characteristics of the oil, including kinematic viscosity (100° C., ASTM D445 "KV100"), Total Base Number (TBN), % water content, % soot content, and selected elemental analyses are presented in the following Table, as a function of distance driven, for a characteristic engine test:

| km | KV100 | Mg % | P % | TBN | $H_2O$ | Soot | Fe ppm |
|---|---|---|---|---|---|---|---|
| 0 | 13.57 | 0.189 | 0.033 | 9.3 | — | — | — |
| 780 | 13.90 | 0.200 | 0.034 | 6.4 | — | 0.06 | 6 |
| 1 924 | 14.25 | 0.200 | 0.034 | 4.7 | — | 0.08 | 8 |
| 3 167 | 15.28 | 0.201 | 0.035 | 2.5 | — | 0.19 | 13 |
| 4 282 | 15.80 | 0.211 | 0.037 | 1.9 | 0.10 | 0.17 | 14 |
| 5 460 | 15.40 | 0.203 | 0.036 | 1.8 | 0.10 | 0.28 | 16 |
| 6 558 | 16.35 | 0.201 | 0.036 | 2.0 | 0.13 | — | 18 |
| 8 596 | 17.49 | 0.207 | 0.038 | 2.0 | 0.12 | — | 23 |
| 9 779 | 17.40 | 0.206 | 0.037 | 2.0 | 0.12 | — | 21 |
| 11 973 | 17.74 | 0.201 | 0.038 | 2.1 | 0.10 | 0.63 | 27 |

— indicates measurement not made

The lubricant satisfactorily lubricates this hydrogen-fueled engine. Oil drain analysis shows very low corrosion or rust, with 6 ppm iron after 780 km and 27 ppm iron after about 11,973 km. There is also only minimal accumulation of water or soot in the lubricant. The viscosity of the lubricant does not vary greatly, exhibiting only a gradual increase over the course of the test. The TBN of the lubricant decreases to about 2 over about 4,000 km with no further appreciable change to the end of the test. The amounts of Mg and P remain approximately constant throughout the test. Although no calcium or zinc components are present in the lubricant formulation, analyses over the course of the test reveal the presence of low amounts of Ca (64 to 89 ppm) and Zn (18 to 39 ppm), probably resulting from incomplete purging of prior lubricant from the engine.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

(a) at least one synthetic oil of lubricating viscosity;

(b) about 3 to about 6 percent by weight of at least one nitrogen-containing dispersant;

(c) about 1 to about 2.5 weight percent of at least one overbased magnesium sulfonate detergent;

(d) 1.5 to about 7 weight percent of at least one antioxidant; and (e) about 0.1 to about 2.5 weight percent of at least one friction modifier selected from the group consisting of fatty esters, fatty amides, amines, sulfur-containing compounds, and borate esters and mixtures thereof;

said composition containing less than about 0.01 weight percent Ca, less than about 0.01 weight percent Zn, about 0.01 to about 0.10 weight percent P, and having a sulfated ash level (ASTM D874) of less than 1.2%.

2. The composition of claim 1 wherein the synthetic oil of lubricating viscosity comprises at least one poly-α-olefin.

3. The composition of claim 1 wherein the amount of mineral oil in the composition is less than about 10 weight percent.

4. The composition of claim 1 wherein the synthetic lubricating oil comprises an ester of a dicarboxylic acid or an ester made from a C5 to C12 monocarboxylic acid and a polyol or polyol ether.

5. The composition of claim 1 wherein the nitrogen-containing dispersant is selected from the group consisting of succinimide dispersants, Mannich dispersants, and mixtures thereof.

6. The composition of claim 1 wherein the nitrogen-containing dispersant is a succinimide dispersant having a TBN of about 100 to about 150.

7. The composition of claim 1 wherein the overbased magnesium sulfonate detergent contributes about 5 to about 12 TBN (ASTM D 4739) to the composition.

8. The composition of claim 1 wherein the antioxidant is selected from the group consisting of hindered phenolic antioxidants, aromatic amine antioxidants, sulfur-containing antioxidants, and mixtures thereof.

9. The composition of claim 1 wherein the antioxidant comprises an ester-containing hindered phenol.

10. The composition of claim 1 wherein the friction modifier is selected from the group consisting of fatty esters, fatty amides, and mixtures thereof.

11. The composition of claim 1 further comprising a phosphorus compound selected from the group consisting of phosphate esters, thiophosphate esters, amine salts of phosphate esters, amine salts of thiophosphate esters, phosphite esters, thiophosphite esters, phosphonates, and phosphosulfurized olefins.

12. The composition of claim 11 wherein the phosphorus compound is a phosphosulfurized olefin.

13. The composition of claim 1 wherein the composition is substantially free of an olefin copolymer viscosity index improver.

14. A composition prepared by admixing the components of claim 1.

15. A method for lubricating an engine, comprising supplying thereto the lubricant composition of claim 1.

16. The method of claim 15 wherein the engine is a hydrogen-fueled engine.

17. The method of claim 16 wherein the engine is an internal combustion engine.

18. The method of claim 15 wherein the engine is fueled by hydrogen from an on-board hydrogen-producing fuel cell.

* * * * *